US006997154B2

(12) United States Patent
Geyer et al.

(10) Patent No.: US 6,997,154 B2
(45) Date of Patent: Feb. 14, 2006

(54) SWITCH ELEMENT

(75) Inventors: Nobert Geyer, Hochstadt (DE); Peter Sailer, Erlangen (DE); Oliver Schnell, Veitsbronn (DE)

(73) Assignee: Ina-Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/088,776

(22) Filed: Mar. 25, 2005

(65) Prior Publication Data

US 2005/0166880 A1 Aug. 4, 2005

Related U.S. Application Data

(62) Division of application No. 09/498,481, filed as application No. PCT/EP03/00307 on Jan. 15, 2003.

(60) Provisional application No. 60/354,628, filed on Feb. 6, 2002.

(30) Foreign Application Priority Data

Feb. 6, 2002 (DE) ..... 102 04 672

(51) Int. Cl.
*F01L 1/18* (2006.01)

(52) U.S. Cl. ..... 123/90.44; 123/90.39; 123/90.45; 123/90.5

(58) Field of Classification Search ..... 123/90.48, 123/90.5, 90.52, 90.39, 90.42, 90.44, 90.45, 123/90.46, 90.16, 90.27, 90.31; 74/567, 74/569

See application file for complete search history.

(56) References Cited

U.S. PATENT DOCUMENTS 4,576,128 A 3/1986 Kenichi ..... 123/198
4,768,475 A 9/1988 Ikemura ..... 123/90.16
5,090,364 A 2/1992 McCarroll et al. ..... 123/90.16
5,255,639 A 10/1993 Shirey et al. ..... 123/90.16
5,402,756 A 4/1995 Bohme et al. ..... 123/90.16
5,555,861 A 9/1996 Mayr et al. ..... 123/90.16

(Continued)

FOREIGN PATENT DOCUMENTS

DE 42 06 166 A1 9/1992

(Continued)

OTHER PUBLICATIONS

O. Schnell, "DaimlerChrysler 5.7L MDS Lifter", (on or about) Jan. 29, 2001, pp. 1-6.

*Primary Examiner*—Thomas Denion
*Assistant Examiner*—Ching Chang
(74) *Attorney, Agent, or Firm*—Fitzpatrick, Cella, Harper & Scinto

(57) ABSTRACT

A switch element (1) is proposed for valve shut-off, fabricated as cam follower for a plunger rod valve drive of an internal combustion engine, having an outer part (2) and an inner element (4) axially movable in its bore (3) and with rotational security (15) relative to the guided inner element (4). The outer part (2), inside the bore (3), has an annular groove (6), and the inner element (4) has a radial bore (7) with two diametrically opposed pistons (8), which to couple the elements (2, 4) in their axially remote relative position achieved by a lost-motion spring (5) are displaceable towards the annular groove (6). On their cam-side under side, emanating from their radially outward, bulbous face, the pistons (8) segmentwise comprise a plane transverse surface as contact area for a facing under side (27) of the annular groove (6). The latter is intersected by two diametrically opposed oil ports (11) running offset 90° from the pistons (8) in circumferential direction. In addition, the outer part (2) has means (13) for rotationally secured guidance of the switch element (1) relative to a surrounding structure.

5 Claims, 1 Drawing Sheet

U.S. PATENT DOCUMENTS

| | | | | |
|---|---|---|---|---|
| 5,651,335 | A | 7/1997 | Elendt et al. | 123/90.16 |
| 5,655,487 | A | 8/1997 | Mass et al. | 123/90.16 |
| 5,669,342 | A | 9/1997 | Speil | 123/90.16 |
| 5,709,180 | A | 1/1998 | Spath | 123/90.16 |
| 5,720,244 | A | 2/1998 | Faria | 123/90.16 |
| 5,782,216 | A | 7/1998 | Haas et al. | 123/90.16 |
| 5,832,884 | A | 11/1998 | Haas et al. | 123/90.16 |
| 5,875,748 | A | 3/1999 | Haas et al. | 123/90.16 |
| 5,893,344 | A | 4/1999 | Church | 123/90.16 |
| 5,934,232 | A | 8/1999 | Greene et al. | 123/90.16 |
| 6,053,133 | A | 4/2000 | Faria et al. | 123/90.16 |
| 6,076,491 | A | 6/2000 | Allen | 123/90.16 |
| 6,092,497 | A | 7/2000 | Preston et al. | 123/90.16 |
| 6,164,255 | A | 12/2000 | Maas et al. | 123/90.16 |
| 6,196,175 | B1 | 3/2001 | Church | 123/90.16 |
| 6,247,433 | B1 | 6/2001 | Faria et al. | 123/90.16 |
| 6,273,039 | B1 | 8/2001 | Church | 123/90.16 |
| 6,321,704 | B1 * | 11/2001 | Church et al. | 123/90.16 |
| 6,321,705 | B1 | 11/2001 | Fernandez et al. | 123/90.16 |
| 6,325,030 | B1 | 12/2001 | Spath et al. | 123/90.16 |
| 6,345,596 | B1 | 2/2002 | Kuhl | 123/90.16 |
| 6,405,699 | B1 * | 6/2002 | Church | 123/90.5 |
| 6,427,652 | B1 * | 8/2002 | Faria et al. | 123/90.16 |
| 6,439,176 | B1 | 8/2002 | Payne et al. | 123/90.12 |
| 6,497,207 | B1 | 12/2002 | Spath et al. | 123/90.16 |
| 6,513,470 | B1 * | 2/2003 | Hendriksma et al. | 123/90.16 |
| 6,578,535 | B1 | 6/2003 | Spath et al. | 123/90.16 |
| 6,588,394 | B1 | 7/2003 | Zheng | 123/198 |
| 6,591,796 | B1 | 7/2003 | Scott | 123/90.13 |
| 2001/0009145 | A1 | 7/2001 | Faria et al. | 123/90.16 |
| 2002/0195072 | A1 | 12/2002 | Spath et al. | 123/90.16 |
| 2003/0075129 | A1 | 4/2003 | Spath et al. | 123/90.16 |
| 2005/0081811 | A1 | 4/2005 | Spath et al. | 123/90.48 |

FOREIGN PATENT DOCUMENTS

| | | | |
|---|---|---|---|
| DE | 43 32 660 | A1 | 3/1995 |
| DE | 43 33 927 | A1 | 4/1995 |
| DE | 198 04 952 | A1 | 8/1999 |
| DE | 199 15 531 | A1 | 10/2000 |
| DE | 199 15 532 | A1 | 10/2000 |
| DE | 199 19 245 | A1 | 11/2000 |
| EP | 0 318 151 | A1 | 5/1989 |
| EP | 0 608 925 | B1 | 8/1996 |
| EP | 1 149 989 | A1 | 10/2001 |
| GB | 574 852 | A | 1/1946 |
| GB | 574852 | | 1/1946 |
| GB | 2 272 022 | | 5/1994 |
| WO | 9530081 | A1 | 11/1995 |

* cited by examiner

SWITCH ELEMENT

CROSS REFERENCE TO RELATED APPLICATIONS

This application is a divisional of U.S. application Ser. No. 10/498,481, filed Jan. 27, 2005, the priority of which is hereby claimed under 35 U.S.C. § 120. U.S. application Ser. No. 10/498,481 is a National Stage filing under 35 U.S.C. § 371 of International Application No. PCT/EP03/00307, filed Jan. 15, 2003. International Application No. PCT/EP03/00307 claims priority of both German Application No. DE 102 04 672.7, filed Feb. 6, 2002, and U.S. Provisional Patent Application No. 60/354,628, filed Feb. 6, 2002, the priorities of each of which are hereby claimed, said International Application having been published in German, but not in English, as International Publication No. WO 03/067038 A1. U.S. application Ser. No. 10/498,481 is hereby incorporated by reference in its entirety, as if fully set forth herein.

BACKGROUND OF THE INVENTION

1. Field of the Invention

The invention relates to a switch element for valve shut-off, fabricated as a cam follower for a plunger rod valve drive of an internal combustion engine.

2. Description of the Related Art

Such a switch element has been disclosed in DE 199 15 531 A1. A disadvantage of this is that only a one-sided coupling is provided over a piston. Therefore, there is an unnecessarily high component load to be reckoned with in the coupling area. Besides, coupling involves an undesirable tilting of the inner element relative to the outer part. At the same time, it is found that the twist safety inserted in the radial bore of the inner element is relatively costly, particularly as its pressing in leads to undesirable deformation of the radial bore, which may adversely affect a proper lengthwise motion of the piston. Since the piston with its cylindrical jacket enters a bore in the outer part for coupling, the latter undesirably has only a very small bearing area, and in this case it is necessary to work with a very fine tolerance. When the piston is not properly run out, it may also happen, owing to the geometry in the transition to the bore, that only two edges bear. Here wear must be reckoned with. Last but not least, the switch element, because of its one-sided oil supply, must be built into its guide directionally.

SUMMARY OF THE INVENTION

The object of the invention, then, is to create a switch element of the kind above mentioned, in which the cited disadvantages are eliminated by simple means.

The switch element proposed eliminates the disadvantages described above.

Two pistons are provided as coupling means, running in the receptacle, configured as a radial bore, of the inner element, and there diametrically opposed to each other. As a result, we have an especially tilt-proof mechanism, generating only a small component load when coupled. Instead of the radial bore in the inner element, a blind hole or similar conformation is also conceivable. Besides, it is a subject matter of claim 1 for the receptacle of the outer part to be advantageously fabricated as an annular groove in its bore.

Further, the inner element is to be secured against rotation relative to the outer part, for example by means of a pin-like element. Thus the coupling means as regards their receptacle are positioned alike over the entire operating period of the switch element.

Likewise, it is proposed that the annular groove be intersected by two diametrically opposed oil ports, such as bores, offset 90° in circumferential direction from the piston. If two leads, opposed to each other, are provided in an oil gallery of a surrounding structure such as for example a cylinder head or guide for the switch element, connected to the internal combustion engine, then it does not matter which oil port of the switch element communicates with which lead. Preferably, the oil paths have equal lengths to achieve equal switch times. In the case of only one lead, of course, a directional installation of the switch element is necessary. Here, suitable markings can be placed on the latter to facilitate assembly.

As suitable means of rotationally securing the switch element relative to the surrounding structure, in a further aspect of the invention, flattenings are proposed on the outer jacket of the outer part.

Also, it is advantageous to provide a roller as cam counterpart.

Instead of the pistons as coupling means, other elements such as latches, balls, wedges and the like geometrical locking elements may be employed. If desired, a dynamic closure is conceivable as well.

BRIEF DESCRIPTION OF DRAWINGS

The invention is illustrated in more detail with reference to the drawings, in which.

DETAILED DESCRIPTION OF THE PREFERRED EMBODIMENT

Figure 1:
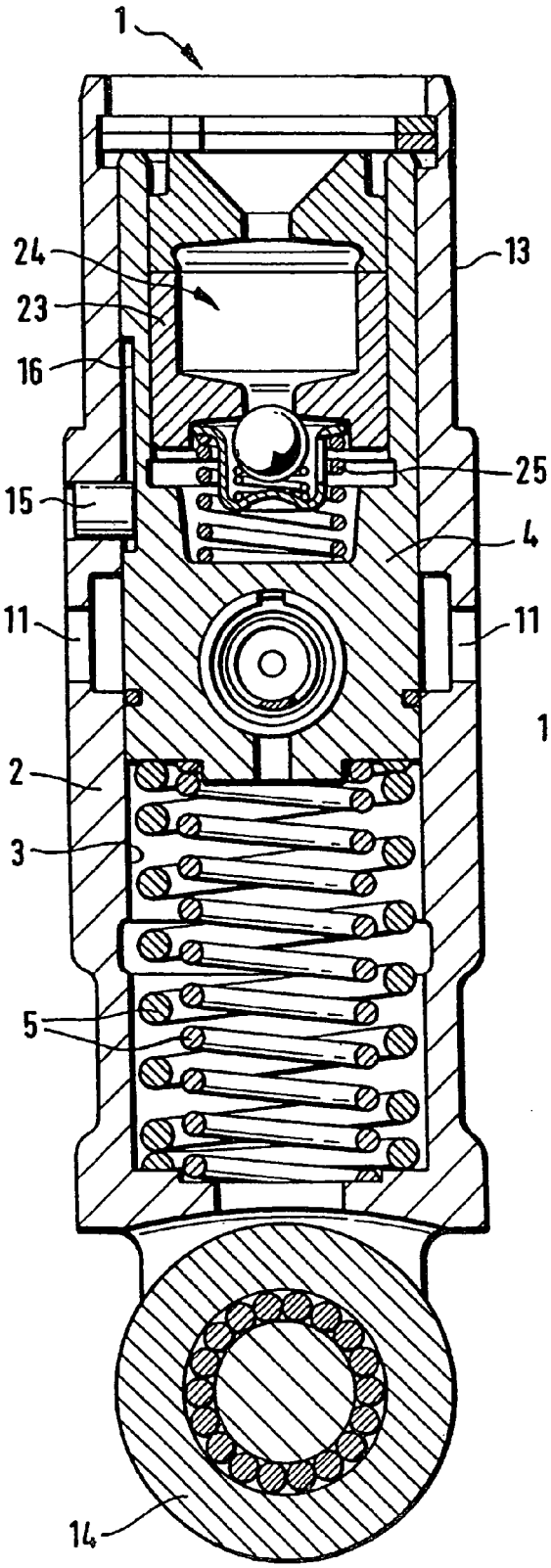
FIG. 1 shows a lengthwise section through a switch element configured as a roller plunger for a plunger rod drive.
Figure 2:
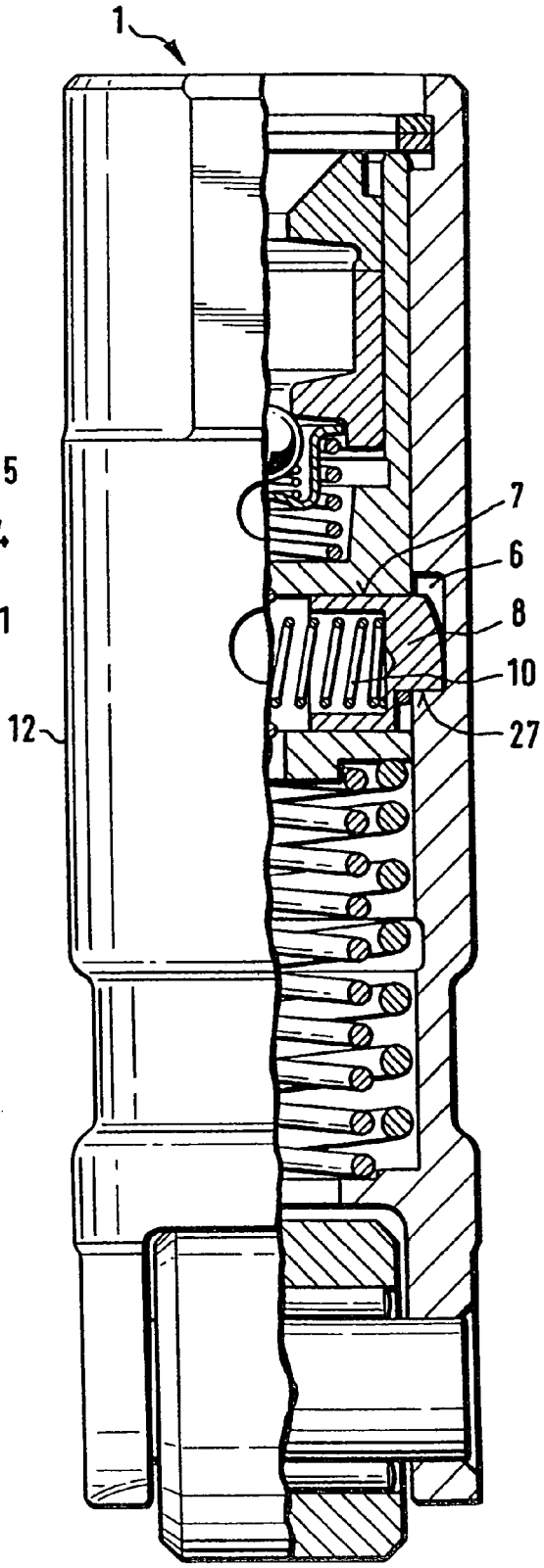
FIG. 2 represents a partial longitudinal section, rotated through 90°, of FIG. 1.

FIGS. 1 and 2 disclose a switch element 1 for a valve drive of an internal combustion engine. This is here configured as a roller plunger for a plunger rod drive. It consists of an outer part 2, in whose bore 3 an axially movable inner element 4 runs. The inner element 4 and the outer part 2 are urged away from each other by a "lost-motion spring" 5, not to be described in detail. The inner element 4 is adapted to receive therein a hydraulic clearance equalization element (lash adjuster 24) having a pressure system (23).

In the axial position of the outer part 2, graphically shown distant from the inner element 4, their receptacles 6, 7 are in line. The receptacle 6 of the outer part 2 is fabricated as an encircling annular groove. The receptacle 7 on the inner element 4, by contrast, is configured as a through bore extending radially. In this, two diametrally opposed coupling means 8 are arranged, here configured as pistons. A radially outer face of the coupling means 8 is shown bulbous, having on its under side segmentally a plane transverse surface as contact area for a facing under side 27 of the annular groove 6 (see FIG. 2).

The couplers 8 are acted upon radially outward by the force of a compression spring means 10 (coupling direction). Radially inward, i.e. in uncoupling direction, the couplers 8 can be displaced by hydraulic means. For this purpose, the outer part 2 may suitably have two diametrically opposed oil ports 11 (see FIG. 1). These are configured as a bore and offset 90° in circumferential direction from the couplers 8.

Further, one skilled in the art will see from the figures that on the outer jacket 12 of the outer part 2, means 13 of security against rotation are applied. These are configured as mutually opposed flattenings. This measure is necessary firstly to connect the oil ports 11 with their supply lines, and secondly to orient a roller 14 with a cam, not shown.

Further, it will be noted that the inner element 4 is likewise secured against rotation relative to the outer part 2. For this purpose, in the outer part 2 a rotational safety 15 (here configured as a pin) is fixed, projecting radially into the bore 3 of the outer part 2. The inner element 4 in turn has a lengthwise recess 16 facing the security 15, on whose flanks the security 15 is guided.

REFERENCE NUMERALS

1 switch element
2 outer part
3 bore
4 inner element
5 "lost motion" spring
6 annular groove
7 radial bore
8 piston
9 unassigned
10 compression spring means
11 oil port
12 outer jacket
13 means
14 roller
15 safety
16 lengthwise recess
17 annular groove
23 pressure piston
24 clearance compensator
25 compression spring
27 under side

What is claimed is:

1. A switch element for a valve drive of an internal combustion engine, the switch element comprising:

an outer part having a bore therein and an annular groove facing the bore;

an anti-rotation safety element fixed to the outer part;

an inner element axially movable in the bore and orientated with respect to the outer part by way of the anti-rotation safety element, the inner element having a radial bore and being adapted to receive a hydraulic clearance equalization element having a pressure system;

a lost-motion spring disposed in the bore of the outer part to urge the inner element away from the outer part; and two diametrically opposed pistons disposed in the radial bore, to be displaced at least partially into the annular groove to couple the inner element to the outer part, the pistons each having a substantially planar transverse lower surface to contact an inner surface of the outer part facing upwardly towards the annular groove, wherein the outer part has two diametrically opposed oil ports offset in a circumferential direction from the pistons, and the outer part also has at least one anti-rotation component providing anti-rotation guidance of the switch element relative to a surrounding structure.

2. A switch element according to claim 1, wherein the anti-rotation safety element is arranged as a radially projecting element, in a lengthwise recess of the inner element, and substantially prevents rotation of the inner element with respect to the outer element.

3. A switch element according to claim 1, wherein the at least one anti-rotation component is formed by one or more substantially flat outer surfaces of the outer part.

4. A switch element according to claim 1, further comprising a roller arranged on the outer part as a cam follower.

5. A switch element according to claim 1, wherein the two diametrically opposed oil ports are offset in a circumferential direction from the pistons by substantially 90°.

* * * * *